United States Patent [19]

Peng

[11] Patent Number: 4,729,741

[45] Date of Patent: Mar. 8, 1988

[54] SAFETY SOCKET

[76] Inventor: Su C. Peng, No. 101-4, Tung Ming Street, Hsinchu City, Taiwan

[21] Appl. No.: 911,733

[22] Filed: Sep. 26, 1986

[51] Int. Cl.[4] ..... H01R 13/44

[52] U.S. Cl. ..... 439/137; 439/135; 439/652

[58] Field of Search ..... 439/135, 137, 652, 654

[56] References Cited

U.S. PATENT DOCUMENTS

| | | | |
|---|---|---|---|
| 4,094,569 | 6/1978 | Dietz | 439/137 |
| 4,206,957 | 6/1980 | Ludwig et al. | 339/40 |
| 4,257,659 | 3/1981 | Gibbs | 339/36 |
| 4,279,457 | 7/1981 | Nickence | 339/40 |
| 4,367,007 | 1/1983 | Nickence | 439/654 |
| 4,463,998 | 8/1984 | Reavis et al. | 439/137 |
| 4,600,258 | 7/1986 | Hu | 439/135 |
| 4,632,479 | 12/1986 | Jacobson | 339/36 |

*Primary Examiner*—Gil Weidenfeld
*Assistant Examiner*—Paula A. Austin
*Attorney, Agent, or Firm*—Stoll, Wilkie, Previto & Hoffman

[57] ABSTRACT

An upper and a lower body having three sockets, two on the upper portion and one on the center of the bottom face of the lower body. Each socket has a slide cover which fits into a track and which can slide back and forth to align and disalign with conductor prong holes. The slide covers each have hook-like legs which slideably secure them in slide cover leg slots. Retainers are on the inside of the upper and lower bodies to hold conductor plates in place. The prongs of a plug, when engaged with the present invention, fit through engagement slots on the slide covers and conductor prong holes to the protruberances of the conductor plate. When not in use, the slide cover can be slid to one side so as to close the passage to the conductor plate.

1 Claim, 4 Drawing Figures

SAFETY SOCKET

BACKGROUND OF THE INVENTION

This invention relates to an improved safety socket with sliding covers to cover the socket holes when they are not in use. In the past, safety sockets had caps which could be placed on top of the socket holes. However, these caps often easily fell off or the plastic strip holding them wore out and broke off.

It is the purpose of this present invention, therefore, to mitigate and/or obviate the above-mentioned drawbacks in the manner set forth in the detailed description of the preferred embodiment.

SUMMARY

A primary objective of this invention is to provide a safety socket with a sliding safety cover.

Another objective of this invention is to provide a safety socket which is engageable on at least two sides.

Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
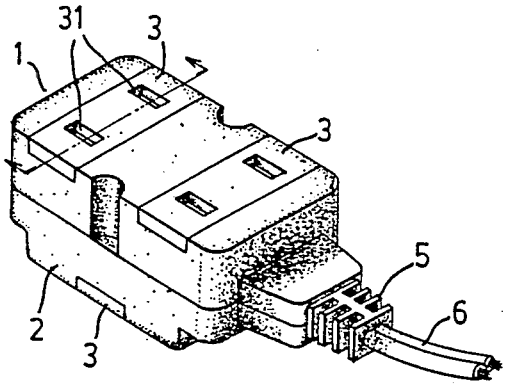
FIG. 1 is a perspective view of the present invention.
Figure 2:
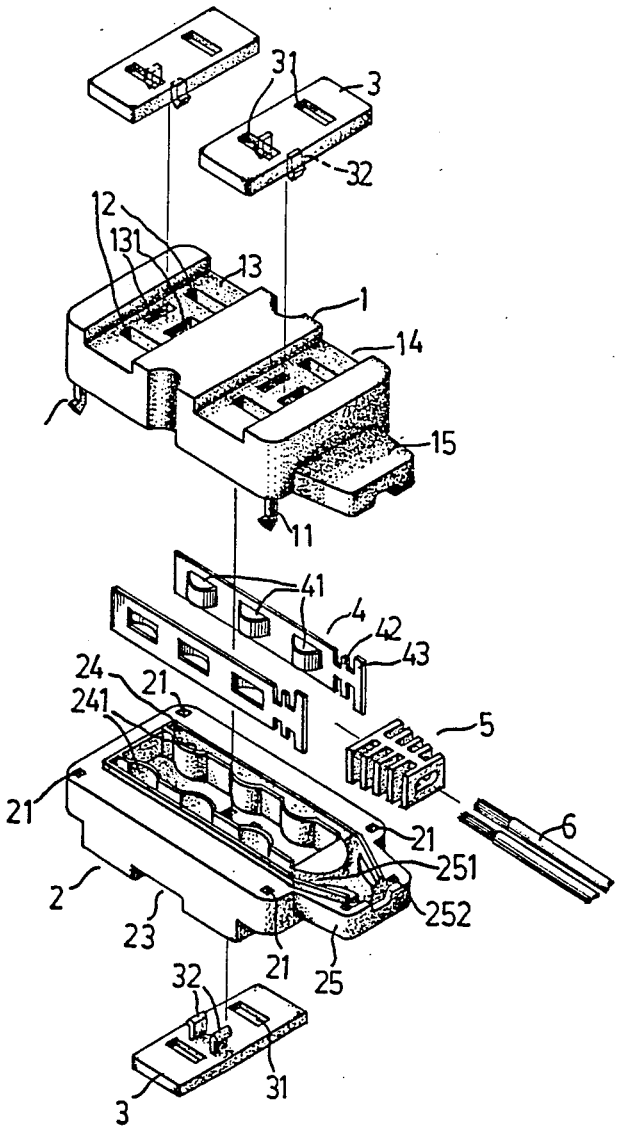
FIG. 2 is an exploded view of the present invention.

Referring to FIG. 1 and 2, it can be seen that the present invention comprises an upper body 1, a lower body 2, slide cover tracks 13, 14, and 23, slide covers 3, a conductor plate 4, a flexor 5 and a conducting wire 6.

From FIG. 2, it can be seen that each of the slide covers 3 have two hook-shaped slide cover legs 32 which are slideably secureable into two slide cover leg slots 131, respectively. The slide covers 3 also have engagement slots 31 through which the prongs of a plug (not shown) can fit.

The upper body 1 also has conductor prong holes 12 which are meant to receive the conductor prongs of a plug. Two slide covers 3 fit respectively into each of the slide cover tracks 13 and 14, which restrict their motion to one direction (i.e. motion in the direction of the slide cover leg slots 131). At one end of the upper body 1 is an upper gate 15 which protects the conducting wire 6. There are four securement legs 11 on the lower part of the upper body 1.

The lower body 2 comprises four leg engagement holes 21, a slide cover track 23 into which a slide cover 3 fits, two retainers 24, and a lower gate 25. The slide cover track 23 is on the bottom outer surface of the lower body 2. The two retainers 24, having three concave curves each, are used to hold two conductor plates 4 in place. The lower gate 25 matches the upper gate 15 so as to provide an entrance and passageway for the conducting wire 6. The conducting wire 6 fits conveniently through the flexor 5 into a conductor channel 251, which directs the two conductors of the conducting wire 6 to the conductor plates 4. There is also a flexor slot 252 at the front of said lower gate 25 into which the largest fin of the flexor 5 fits. The four leg engagement holes 21 receive the four securement legs 11 on the lower part of the upper body 1.

A conductor plate 4 fits between each retainer 24 and the inside wall of the lower body 2. Each of these two conductor plates 4 has three protruberances 41 which fit into the three convex curves in each of the retainers 24. These protruberances 41 provide stability for the conductor plate 4 and also make the electrical contact more firm between each of the conductor plates 4 and their corresponding retainers 24. In addition, the conductor of the conducting wire 6 can be connected to each of the conducting plates at connecting post 42, to ensure a good electrical connection. The jacket (plastic coating) of the conducting wire 6 can also be connected to a jacket post 43, so as to ensure the conducting wire 6 does not become disconnected from the conductor plate 4.

Figure 3:
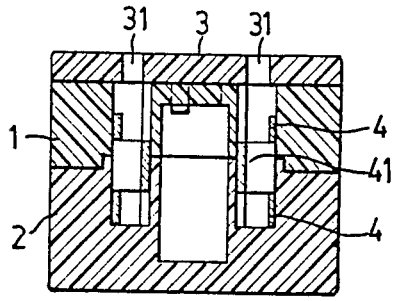
FIG. 3 is a cross-sectional view of the present invention taken across the center plane of one of the two outer sockets, with the slide cover shown in aligned (closed) position.
Figure 4:
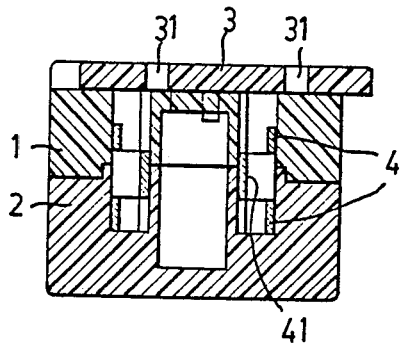
FIG. 4 is a cross-sectional view of the present invention taken across the center plane of one of the two outer sockets, with the slide cover shown in disaligned (open) position.

Referring to FIG. 3, it can be seen that when the slide cover 3 is aligned with (i.e. positioned directly above) the conductor prong holes 12, that the prongs of a plug (not shown) could respectively fit in between each of the conducting plates 4 and the inside of protuberances 41 thereof. When one of the slide covers 3 is slid in one of the slidecover tracks (13, 14, or 23) to the right, as seen in FIG. 4, the engagement slots 31 and the conductor prong holes 12 do not align. This safety feature prevents other conductive objects from coming into contact with the conducting plates 4 inside the socket of the present invention. This feature is especially useful when there are children around, since children are more likely to try to stick an object, other than a plug, into a socket.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. An improved safety socket comprising:

(A) an upper body with four securement legs on the lower corners thereof, said upper body having two slide cover tracks; each slide cover track having two conductor prong holes and two slide cover leg slots;

(B) a lower body with a plurality of leg engagement holes for receiving the four securement legs of said upper body, said lower body having a slide cover track on a bottom center surface thereof, said slide cover track in said lower body having two conductor prong holes and two slide cover leg slots, a top surface of said lower body having two retainers;

(C) three slide covers, two of which fit into said two slide cover tracks on said upper body and one of which fits into said slide cover track on said lower body, each of said three slide covers having engagement slots through which conductor prongs of a plug can fit, said slide covers having slide cover legs which are slidably engageable with slide cover leg slots on said upper and lower bodies, respectively; said three slide covers being slidably adjustable so as to be alignable and disalignable with corresponding conductor prong holes;

(D) a two conductor conducting wire; and (E) two conducting plates, said two plates being respectively retained by said retainers, each of said conducting plates being electrically connected to one of said conductors of said conducting wire.

* * * * *